US005844490A

United States Patent [19]

Lu et al.

[11] Patent Number: 5,844,490

[45] Date of Patent: Dec. 1, 1998

[54] MONITORING DEVICE FOR A CHEMICAL REAGENT SUPPLY SYSTEM

[75] Inventors: Chung-Chien Lu; Eric Liu; His-Huang Lee, all of Hsinchu; Tien-Tsai Lu, Hsinch Hsien, all of Taiwan

[73] Assignee: United Microelectronics Corp., Taiwan

[21] Appl. No.: 844,762

[22] Filed: Apr. 22, 1997

[30] Foreign Application Priority Data

Nov. 29, 1996 [TW] Taiwan ..... 85218501

[51] Int. Cl.[6] ..... G08B 21/00

[52] U.S. Cl. ..... 340/603; 340/661; 340/686; 417/1; 417/63; 417/44.7; 417/279; 222/1; 137/2; 137/15.2; 73/861; 364/479.1

[58] Field of Search ..... 340/603, 611, 340/612, 614, 616, 661, 686, 825.06; 417/1, 63, 20, 44.7, 473, 279, 510; 73/168, 53.01, 866, 861.39, 861; 137/2–9, 15.2, 88, 114, 551; 222/1; 364/479.09, 528.01, 479.1

[56] References Cited

U.S. PATENT DOCUMENTS

| | | | |
|---|---|---|---|
| 5,033,321 | 7/1991 | Gerson | 73/866 |
| 5,421,208 | 6/1995 | Packard et al. | 73/861 |
| 5,433,237 | 7/1995 | Kao et al. | 137/8 |
| 5,695,092 | 12/1997 | Schrandt | 222/1 |

*Primary Examiner*—Donnie L. Crosland
*Attorney, Agent, or Firm*—Rabin & Champagne, P.C.

[57] ABSTRACT

A monitoring device for a chemical reagent supply system includes a position voltage generator, mounted to a pump of the supply system, to monitor the expansion state of a bellows. The actual outflow of the chemical reagent is calculated by the position voltage generator. According to a demand signal from equipment needing the chemical reagent, which is processed to consider the viscosity of the chemical reagent, a theoretic demand outflow is calculated by the monitoring device. When the difference between the actual outflow and the theoretic demand outflow exceeds a permissible tolerance, the monitoring device raises an alarm signal to warn an operator and thereby to assure the accuracy of the chemical reagent supply system.

10 Claims, 7 Drawing Sheets

MONITORING DEVICE FOR A CHEMICAL REAGENT SUPPLY SYSTEM

BACKGROUND OF THE INVENTION

1. Field of the Invention

The invention relates in general to a monitoring device for a chemical reagent supply system, and more particularly to a device mounted to a chemical pump of a chemical reagent supply system to monitor the outflow of the pump.

2. Description of the Related Art

In the fabrication of semiconductor devices, some equipment used in the manufacturing processes needs a supply of liquid chemical reagents. For example, a photo-resistant liquid is needed for a photolithography process. The supply of these liquid chemical reagents is performed using a pump which draws the reagents from a reservoir and ejects the reagents to the equipment. FIG. 1 is a layout view illustrating a conventional supply system of liquid chemical reagent used in photolithography equipment. Referring to FIG. 1, a supply system 20 of liquid chemical reagent includes an air source 14, a regulator valve 13, a pump 15, a tank of liquid 16, a filter 17 and a throttle valve with check valve device 18. A photolithography mechanism 11 converts the demand for a photo-resistant liquid into a signal. The signal is transmitted to control the regulator valve 13 via a wire 12. The regulator valve 13 governs the supply of compressed dry air (CDA) from the air source 14 and controls the action of the pump 15. The pump 15 draws the photo-resistant liquid from the tank 16 and pumps it through the filter 17 to the photolithography mechanism 11. The throttle valve with check valve device 18 is applied to adjust the flow of CDA which drives the pump 15. The conventional supply system 20 governs the outflow of chemical reagent by controlling the operating time of the pump 15.

FIG. 2A and FIG. 2B are elevational views of a conventional chemical pump with sensor devices. Referring to these figures, the pump includes a cylinder 21, a piston 39, a piston rod 22, a number of magnets 23, a bellows 24, a pipe 34, two ball switches 35, 36 and two sensors 27, 28. As shown in FIGS. 2A and 2B, the magnets 23 are mounted to the circular periphery of the piston 39. One end of the piston rod 22 is mounted to the piston 39, while the other end of the piston rod 22 is mounted to one end of the bellows 24 to alternately compress and expand the bellows 24. The pipe 34 has two ends, that is, an upper end 37 and a lower end 38, wherein the upper end 37 is mounted to the photolithography mechanism 11, while the lower end 38 is mounted to the reservoir 16 (See FIG. 1). The other end of the bellows 24 is mounted to the pipe 34 between the upper end 37 and the lower end 38. The pipe 34 has a first ball switch 35 located between the upper end 37 and the junction of the bellows 24 and the pipe 34 and a second ball switch 36 located between the lower end 38 and the junction of the bellows 24 and the pipe 34. The cylinder 21 has two slide valves, including a first slide valve 25, and a second slide valve 26, and two sensors, including a first sensor 27, and a second sensor 28, respectively disposed at the two opposite ends of the cylinder 21.

Referring to FIG. 2A, when the CDA is supplied into the cylinder 21 through the second slide valve 26, the piston 22 is pulled to a back end of the cylinder 21 (the left end of the cylinder 21 in FIG. 2A) so that the bellows 24 is expanded. Due to gravity and fluid mechanics, when the bellows 24 expands, the first ball switch 35 is closed while the second ball switch 36 is opened. The liquid chemical reagent is drawn from the reservoir into the bellows 24. When the first sensor 27 is active by the magnets 23 induce, the second slide valve 26 stops breathing and begins to exhaust the CDA. At the same time, the CDA is supplied through the first slide valve 25. The piston 39 is pushed to the front end of the cylinder 21 (the right end of the cylinder 21 in FIG. 2B) so that the bellows 24 is compressed. At this time, the first ball switch 35 is opened while the second ball switch is closed. The liquid chemical reagent which was previously pumped into the bellows 24 now is pumped to the photolithography mechanism through the first ball switch 35. When the second sensor 28 is active by the magnets 23 induce, the first slide valve 25 begins to exhaust the CDA, while the second slide valve 26 breathes in the CDA. These actions described above are performed repeatedly.

The conventional chemical pump with sensor devices operates to supply a chemical reagent in the way described above. The outflow of the chemical reagent is determined by the run time of the pump. However, the inventor has observed that the filter may become jammed and when the filter is jammed, the run time of the pump is delayed so that an incorrect amount of the chemical reagent flows on period time. An incorrect outflow time because of the chemical viscosity change results in poor quality product.

FIG. 3A and FIG. 3B are elevational views of another conventional chemical pump with throttle devices. Referring to these figures, two throttle devices 29A and 29B are mounted to the cylinder 21 at the first slide valve 25 and the second slide valve 26, respectively. The throttle devices 29 include check valves (30, 32) and throttle valves (31, 33), respectively. When the cylinder 21 draws the chemical reagent from a reservoir through the lower end 38 of the pipe 34, the CDA is supplied to the cylinder 21 through the check valve 30 and the second slide valve 26. The CDA is exhausted from the cylinder 21 through the first slide valve 25 and the throttle valve 33. Then, the piston 39 is pulled to the back end of the cylinder 21 (the left end in FIG. 3A). When the chemical reagent is being pumped to the photolithography mechanism through the upper end 37, the CDA is being supplied to the cylinder 21 through the check valve 32 and the first slide valve 25. At the same time the CDA is exhausted from the cylinder 21 through the second slide valve 26 and the throttle valve 31. Then the piston 39 is pushed to the front end of the cylinder 21 (the right end in the FIG. 3B). These actions described above are performed repeatedly.

The above-described conventional chemical pump governs the outflow of the chemical reagent by means of a throttle device controlling the flow of CDA in a supplying and exhausting period. However, the inventor has observed that some situations cause an erroneous amount of outflow of the chemical reagent. For example, an air leak may occur in the throttle device or the cylinder, or the filter may become jammed. This may result in a poor quality product.

SUMMARY OF THE INVENTION

It is therefore an object of the invention to provide a device for a chemical pump to monitor the outflow of the chemical reagent. In accordance with the invention, a position voltage generator is mounted to detect the travel of the piston, so that the outflow of the chemical reagent can be calculated. When the difference between the actual outflow and a predetermined volume is beyond a specific quantity, for example, because of a jammed filter, the monitoring device sets off an alarm.

The invention achieves the above-identified objects by providing a new monitoring device for a chemical reagent supply system. The chemical reagent supply system includes at least a pressurized air source, a pump, a regulator valve and a signal source. The pump includes a cylinder, a piston, a piston rod mounted to the piston and a bellows mounted to the piston rod. The regulator valve is mounted to the air source and the cylinder to govern the travel of the piston. The signal source is coupled to the regulator valve, and generates a first signal to drive the regulator valve.

The monitoring device according to the invention includes a pre-treatment circuit, a position voltage generator, a voltage generating device, a voltage buffer amplifier, a subtracter, a comparator, an overriding mode selector, an overriding device and an alarm device. The pre-treatment circuit is coupled to the signal source. The pre-treatment circuit is responsive to a first signal input from the signal source, to produce a second signal as an output. The position voltage generator is mounted to the bellows. The position voltage generator generates a first voltage according to the state of expansion of the bellows. The voltage generating device is coupled to the pre-treatment circuit. The voltage generating device is responsive to the second signal to produce a second voltage according to the viscosity of a fluid in the bellows.

The voltage buffer amplifier is coupled to the position voltage generator. The voltage buffer amplifier is responsive to the first voltage, to produce a third voltage by processing which includes offsetting, adjusting and amplifying the first voltage. The subtracter is coupled to the voltage generating device and the voltage buffer amplifier and generates a fourth voltage according to the difference between the second voltage and the third voltage. The comparator is coupled to the output of the subtracter, and generates an overriding signal by comparison of the fourth voltage with a minimum voltage and a maximum voltage. The overriding mode selector is coupled to the output of the pre-treatment circuit, and generates a control signal according to the second signal. The control signal is provided to control the lock period of the overriding signal. The overriding device is coupled to the comparator and the overriding mode selector, to receive the control signal, and the overriding signal, locks the overriding signal according to the control signal, and continually outputs an alarm signal. The alarm device is coupled to the overriding device to receive the alarm signal, and outputs an alarm according to the alarm signal.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

Figure 1:
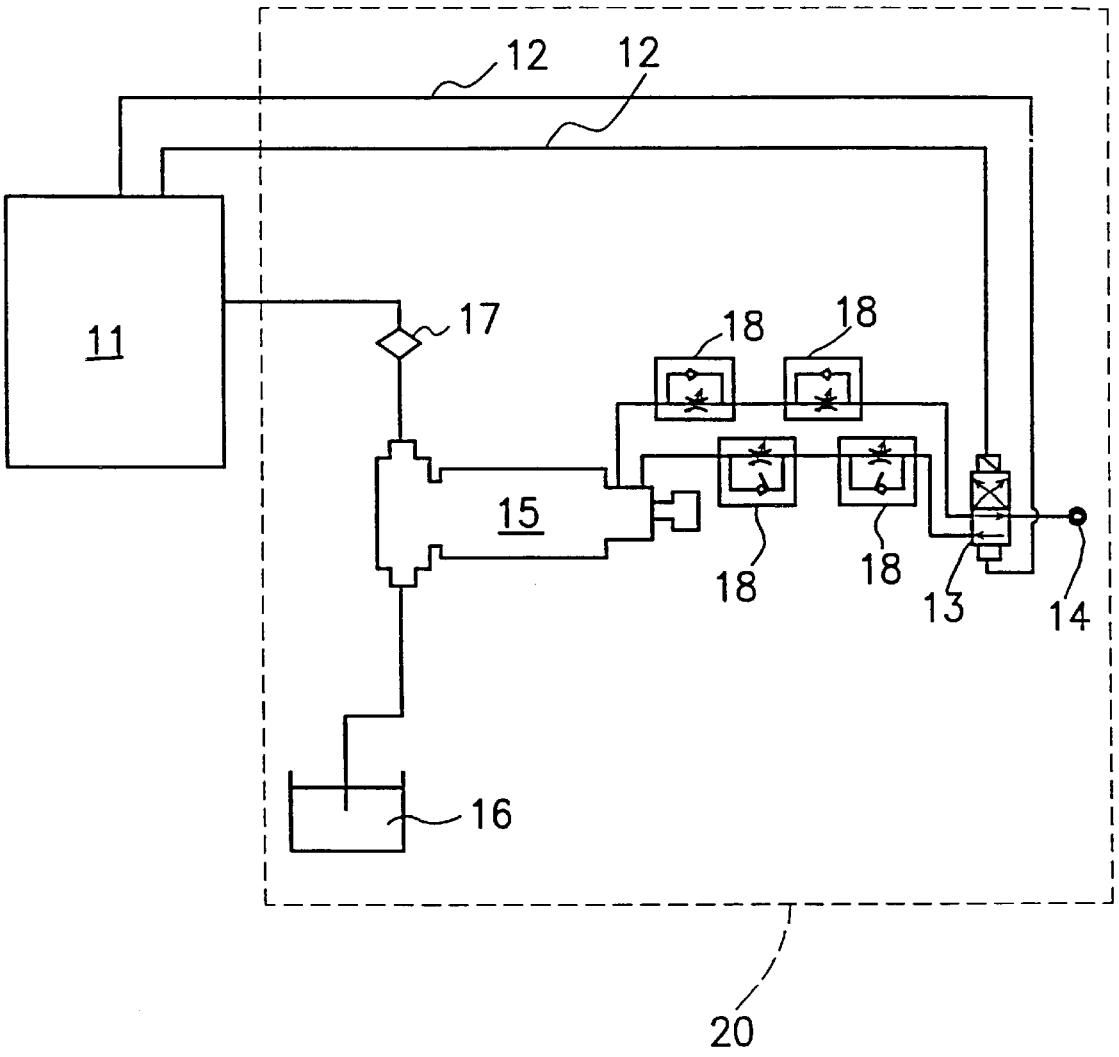
FIG. 1 (PRIOR ART)
FIG. 1 (Prior Art) is a layout view illustrating a conventional supply system of liquid chemical reagent used in photolithography equipment.
Figure 2A:
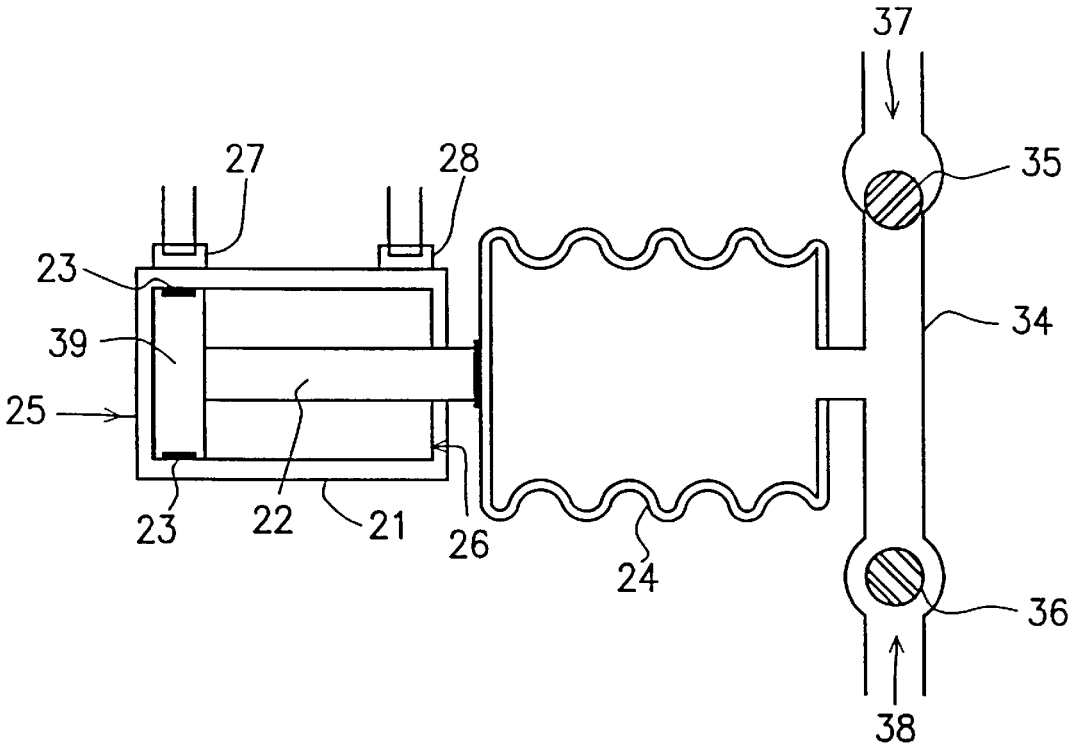
FIG. 2A (PRIOR ART)
FIG. 2A and FIG. 2B (Prior Art) are elevational views of a conventional chemical pump with sensor devices.
Figure 2B:
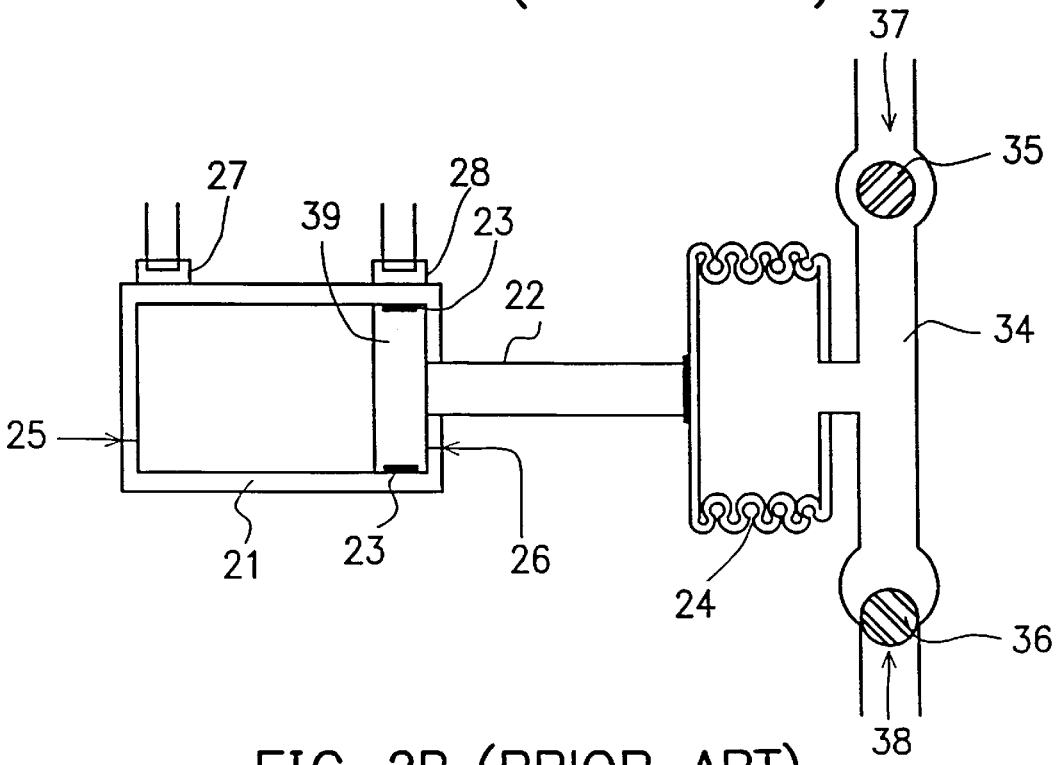
FIG. 2B (PRIOR ART)
Figure 3A:
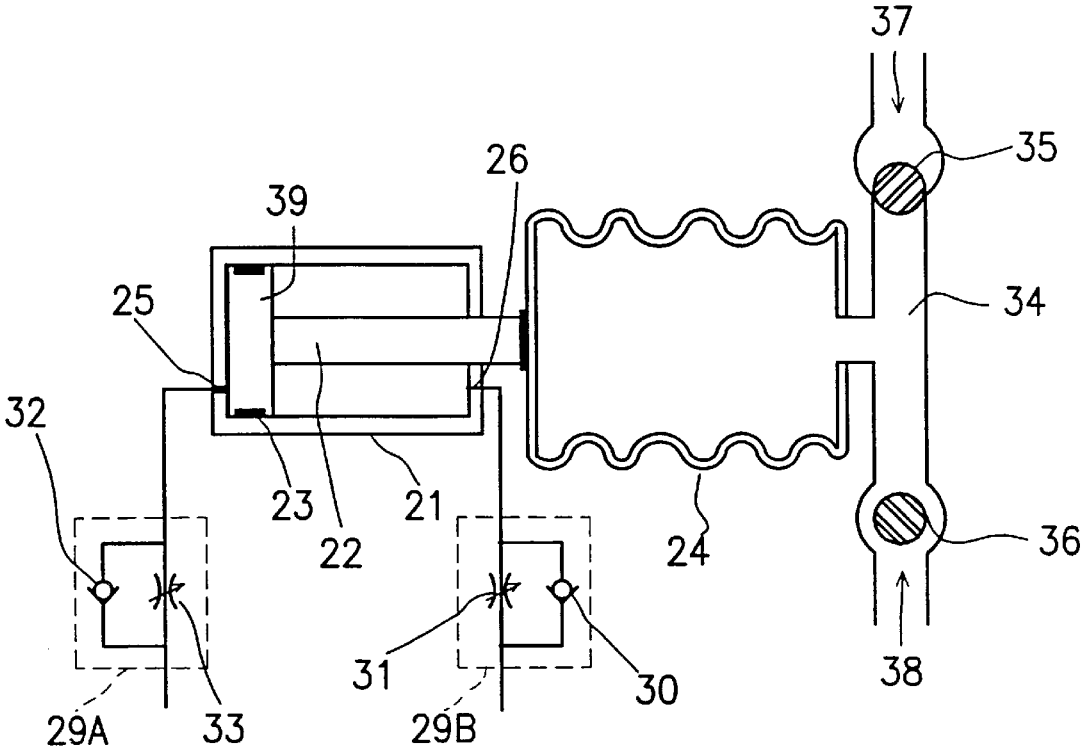
FIG. 3A (PRIOR ART)
FIG. 3A and FIG. 3B (Prior Art) are elevational views of another conventional chemical pump with throttle devices.
Figure 3B:
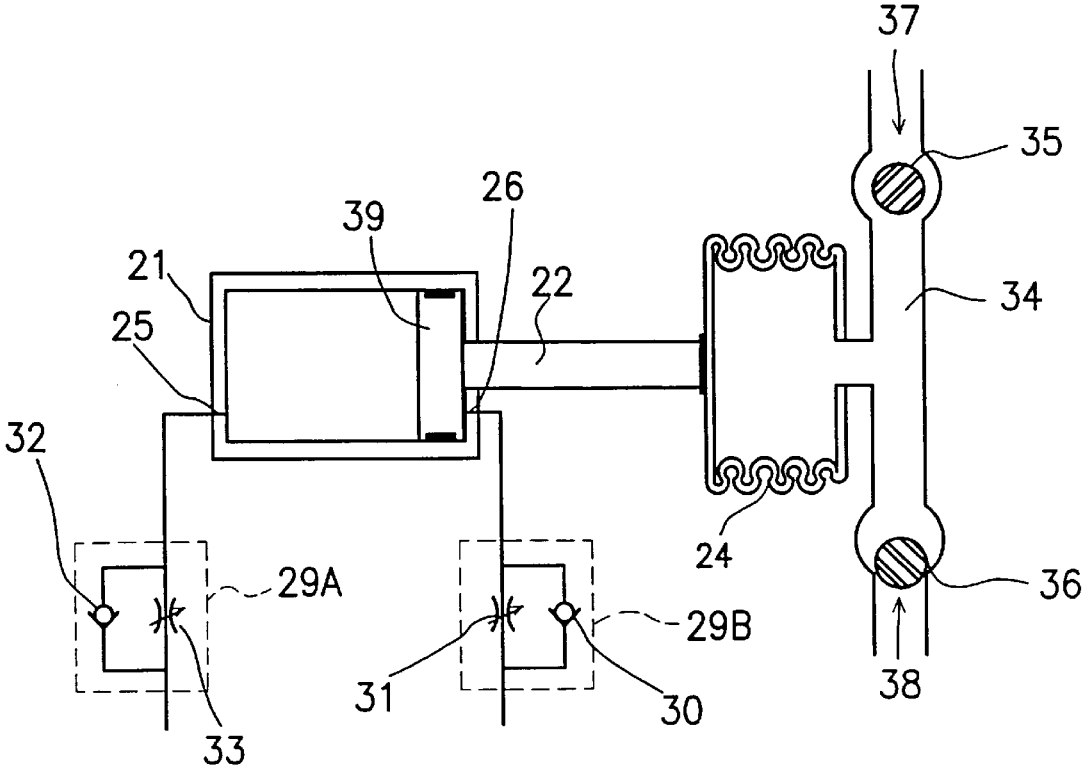
FIG. 3B (PRIOR ART)
Figure 4:
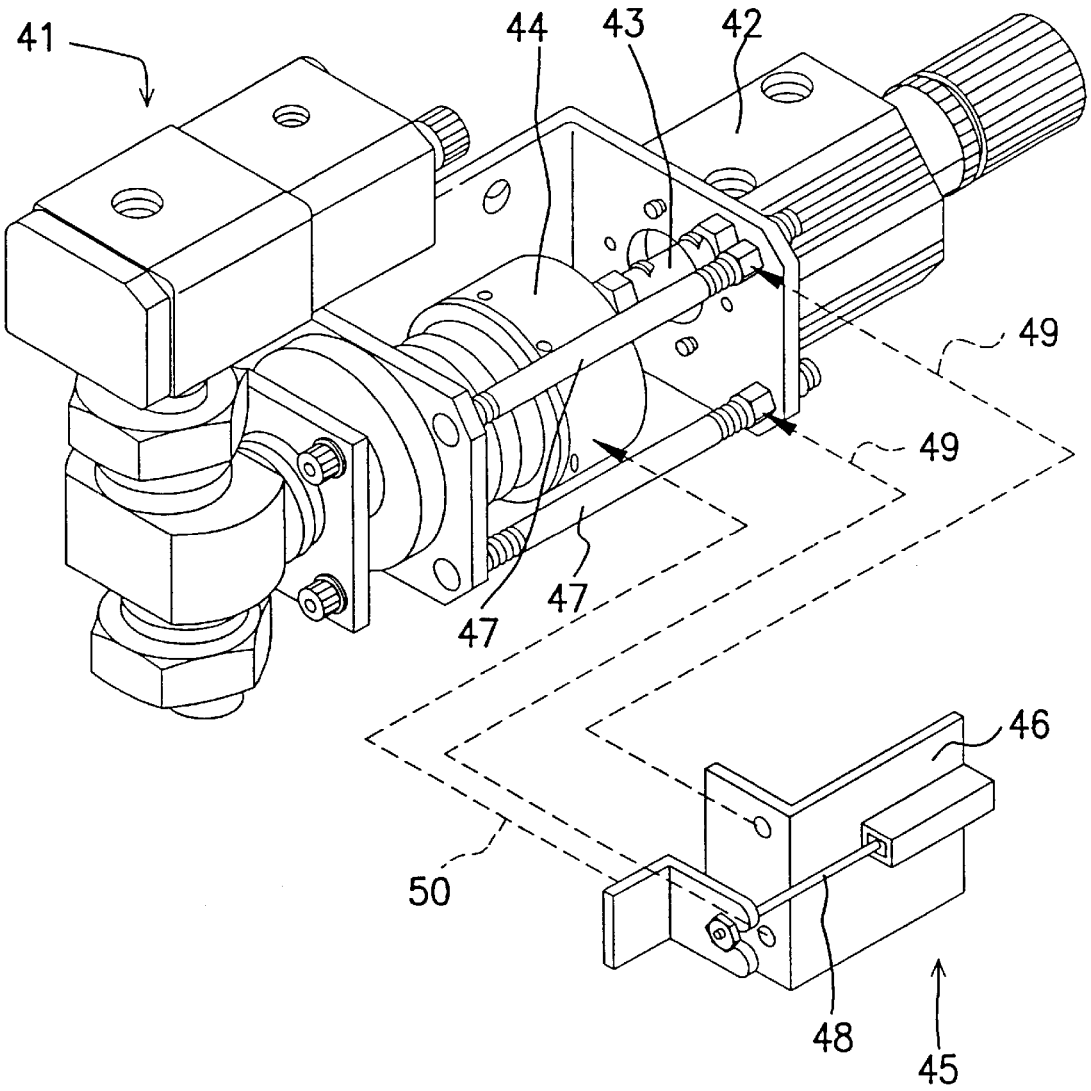
FIG. 4 is a schematic, partially exploded view of a position voltage generator which is an element of one preferred embodiment of a monitoring device according to the invention.

Referring to FIG. 4, a conventional chemical pump 41 includes at least a cylinder 42, a piston and piston rod 43, and a bellows 44. According to the invention, a position voltage generator 45 is fixedly mounted to the chemical pump 41. For example, the body 46 of the position voltage generator 45 is fixed to the chemical pump 41 by a screw bolt 47 (where shown by the dashed line 49). The sense shaft 48 is fixed to the bellows 44 by, for example, soldering (as the dashed line 50 shows), so that the sense shaft 48 changes its relative position to the body 46 according to the state of expansion of the bellows 44.

Figure 5A:
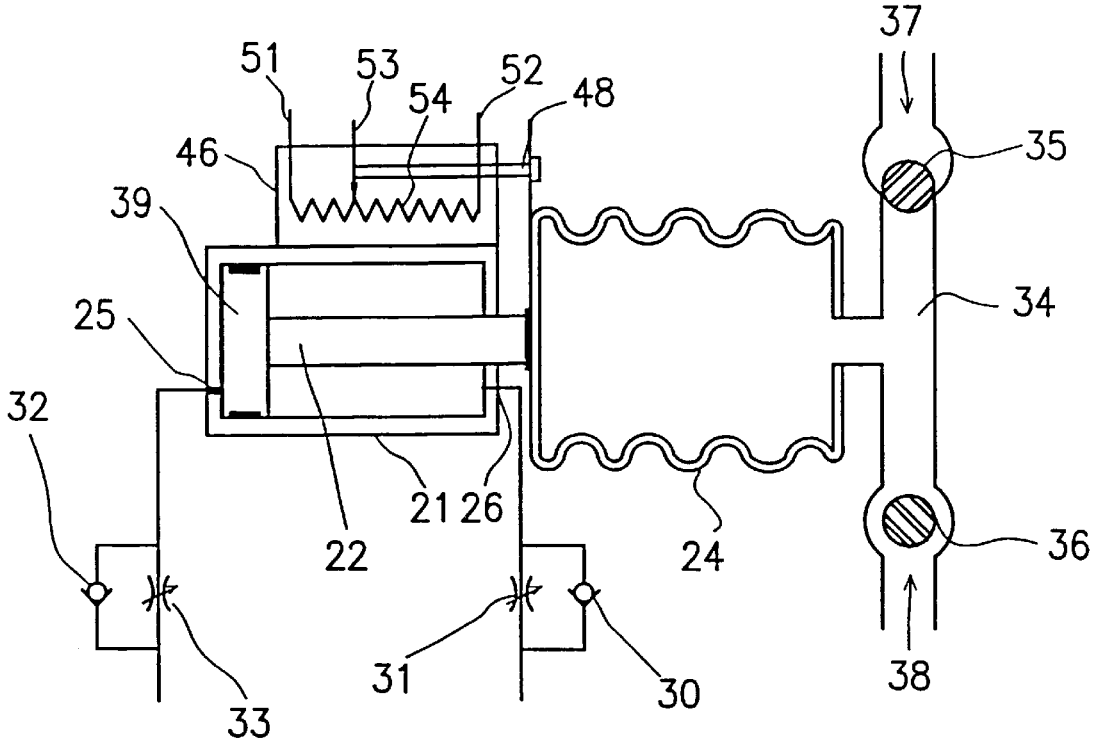
FIG. 5A and FIG. 5B are elevational views of the position voltage generating device at different stages of operation.
Figure 5B:
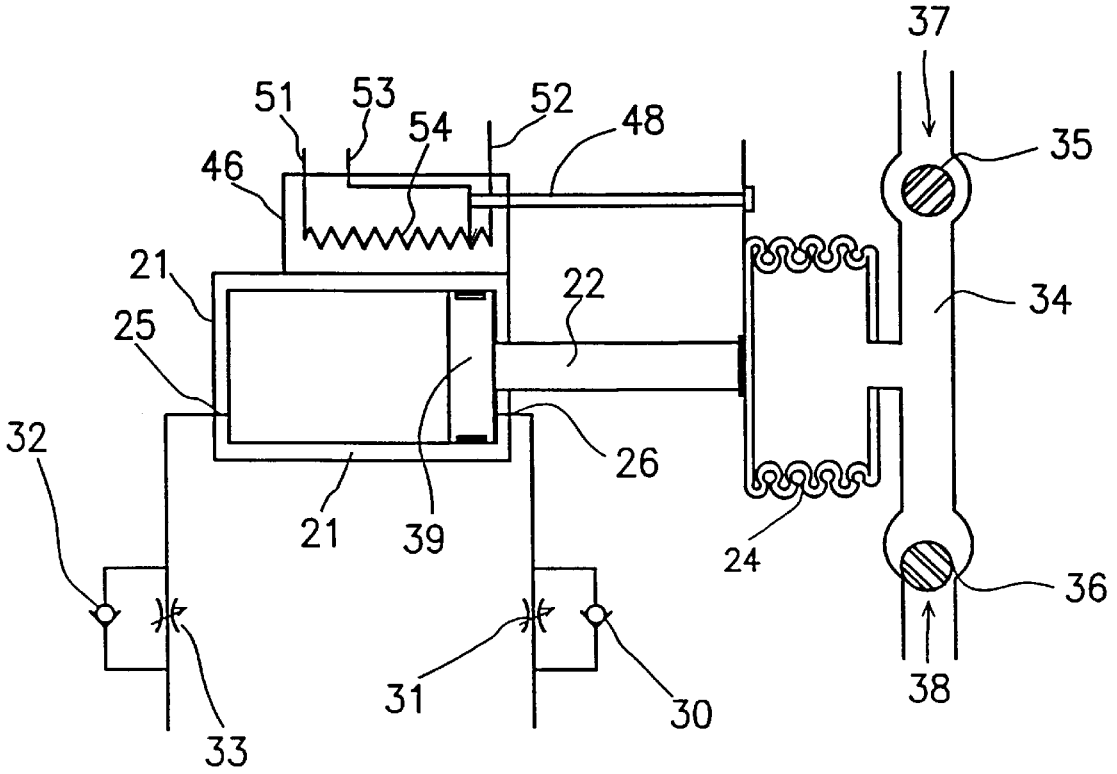

Referring to FIG. 5A and FIG. 5B, the chemical pump is similar to the conventional chemical pump with throttle devices as described above, and operates in the same manner as described above. The body 46 of the position voltage generator is stationary, being fixed to the cylinder 21. A fixed voltage is provided between two electric poles of the generator: a first electric pole 51 and a second electric pole 52. For example, the second electric pole 52 is provided a positive voltage of 5 volts, while the first electric pole 51 is grounded. A third electric pole 53 is mounted to a sense shaft 48, and mounted in a sliding manner to a resistor 54 that is provided between the two poles 51 and 52. The third electric pole 53 is applied to an output pole.

The operating principle of the position voltage generator 45 is similar to that of a varistor. When the bellows 24 expands, the sense shaft 48 is pushed so that the position at which the third electric pole 53 contacts the resistor 54 changes. As a result, the resistance between the third electric pole 53 and the second electric pole 52 increases so that the output voltage decreases, for example, to 0.1 volt.

Contrarily, referring to FIG. 5B, when the bellows 24 compresses, the sense shaft is pulled so that the position at which the third electric pole 53 contacts the resistor 54 changes. As a result, the resistance between the third electric pole 53 and the second electric pole 52 decreases so that the output voltage increases, for example, to 4.5 volts. Due to the linear characteristics of the resistor, the relation between the output voltage and the sense shaft displacement is linear, that is, the relation between the output voltage and the degree of expansion of the bellows is linear. Therefore, the actual outflow of the chemical reagent can be calculated by the output voltage.

Figure 6:
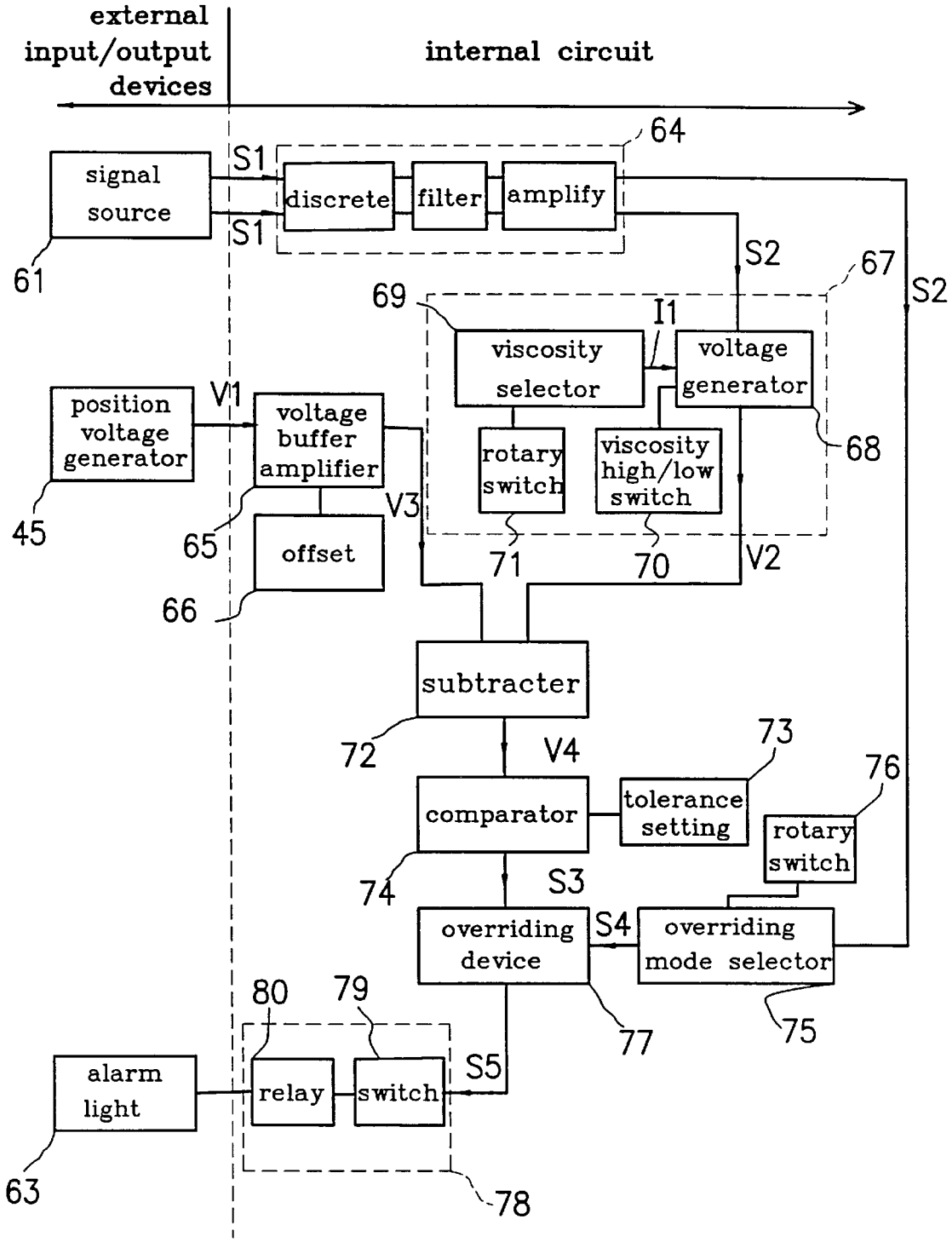
FIG. 6 is a schematic circuit drawing of one preferred embodiment of a monitoring device according to the invention.

Referring to FIG. 6, the left part of the drawing illustrates external input/output devices, including a signal source 61, position voltage generator 45, and an alarm light 63. The signal source 61 includes a signal catch device which catches the first signal S1 from photolithography equipment. The position voltage generator 45 is mounted to the pump as described above. The alarm light 63 is preferably mounted to a panel. The right part of the drawing illustrates circuits and devices to accomplish the function of the monitoring device. A pre-treatment circuit 64 is coupled to the signal source 61. The major function of the pre-treatment circuit 64 is to convert an analog signal to a discrete signal, filter noise from the signal, and amplify the signal. Receiving the first signal S1 as an input, the pre-treatment circuit 64 converts the first signal S1 to a second signal S2 based on the processing mentioned above. The second signal S2 is a digital signal which servers as a clock signal for a successive process.

Figure 7:
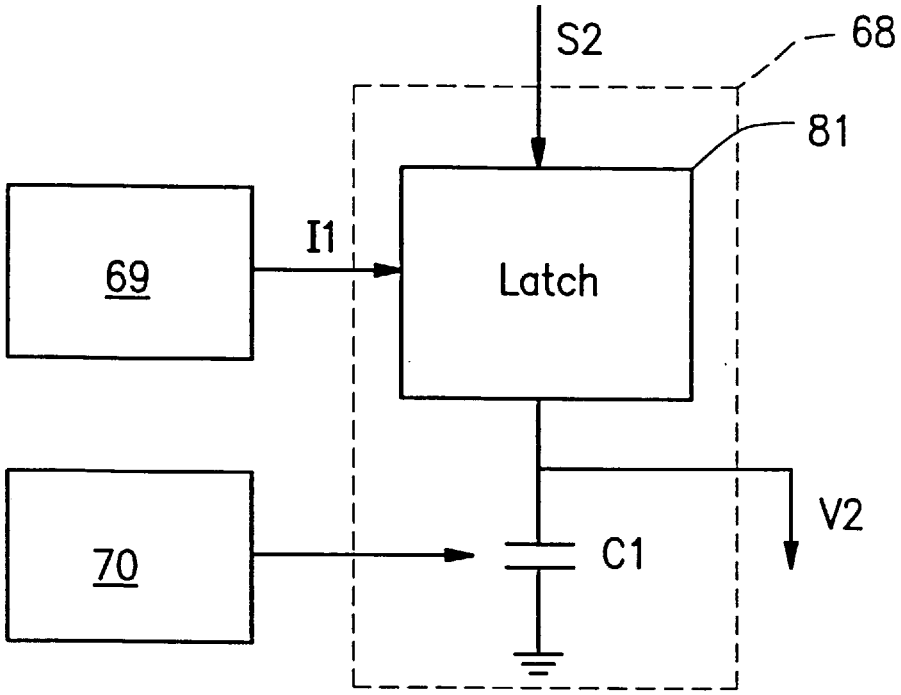
FIG. 7 is a schematic circuit drawing of the voltage generator.

A voltage generating device 67 is coupled to the pre-treatment circuit 64. The second signal S2 is transmitted from the pre-treatment circuit 64 to the voltage generating device 67. The voltage generating device 67 includes a voltage generator 68, a viscosity selector 69, a viscosity high/low switch 70, and a rotary switch 71. The viscosity selector 69 generates a charge current I1 according to a setting of the rotary switch 71. Referring to FIG. 7, the viscosity high/low switch 70 is applied to switch the capacitance of a capacitor C1. When the charge current I1 and the capacitance of the capacitor C1 are determined respectively, by the rotary switch 71 and the viscosity high/low switch 70, the second signal S2 serves as a clock signal for a latch 81 and governs the charge period of the capacitor C1. In response to the second signal S2, the capacitor C1 discharges a second voltage V2 as an output of the voltage generating device 67. The second voltage V2 represents the theoretical demand for the reactant in a voltage form.

The position voltage generator 45 which is mounted to the chemical pump has as an output a first voltage V1 corresponding to the state of expansion of the bellows of the pump. A voltage buffer amplifier 65 is coupled to the position voltage generator 45 to receive the first voltage V1. The voltage buffer amplifier 65 buffers and amplifies the first voltage V1. In addition, the first voltage V1 is preferably adjusted by an offset (as the block 66 shows). In response to the processing described above, the first voltage V1 is converted into a third voltage V3. The third voltage V3 represents the actual outflow of chemical reagent in a voltage form.

A subtracter 72 is coupled to the voltage generating device 67 and the voltage buffer amplifier 65 to receive as inputs the second voltage V2 (the theoretical demand voltage) and the third voltage V3 (the actual outflow voltage), and generates a fourth voltage V4 as an output which has a value equal to the difference between the second and the third voltages. When the third voltage V3 is larger than the second voltage V2, it shows that the actual outflow of the chemical reagent exceeds the demand. Contrarily, when the third voltage V3 is less than the second voltage V2, it shows that the actual outflow of the chemical reagent is below the demand.

A comparator 74 is coupled to the subtracter 72. The comparator 74 preferably includes a tolerance setting device 73 which is applied to set both a maximum voltage and a minimum voltage, that is, a predetermined voltage range defining a tolerance of the fourth voltage V4. The comparator 74 has as an input the fourth voltage V4, and generates as a continuous output a digital overriding signal S3 based on the comparison of the fourth voltage V4 with the minimum voltage and the maximum voltage.

An overriding mode selector 75 is coupled to the pre-treatment circuit 64. The overriding mode selector 75 operates as a latch. Because of the mechanical damping of the pump and the delay effect of the circuit, only a period of the overriding signal S3 is valid according to actual experiment. Therefore, the second signal S2 is taken as a clock signal. The overriding mode selector 75 has the second signal S2 as an input, and generates a control signal S4 according to the second signal S2 and a setting of a rotary switch 76. The control signal S4 is applied to govern the period of the overriding signal S3 which is locked by an overriding devise 77, and avoid error.

The overriding device 77 is coupled to the comparator 74 and the overriding mode selector 75. According to the control signal S4, the overriding device 77 locks the overriding signal S3 and generates a continuous digital alarm signal S5. When an inaccurate outflow occurs, the alarm signal S5 has a value of 1, and is maintained for a period time due to the locking performed by the overriding device 77. An alarm device is coupled to the overriding device 77 and has as an input the alarm signal S5. The alarm device includes an alarm output circuit 78 and an alarm light 63. Further, the alarm circuit 78 includes a relay 80 and a switch 79. The relay 80 provides electrical energy to the alarm light 63. An operator can shut down the alarm light 63 by the switch 79. When the value of the alarm signal S5 is 1, the alarm light 63 is "on" to warn the operator of the error. The alarm light may be replaced by other alarm equipment, for example, an alarm bell.

The above-described invention possesses several advantages. For example, the invention measures the outflow of chemical reagent using a position voltage generator. Because the position voltage generator is an external device, it is suitable for various pumps. Further, by using the viscosity selectors, the monitoring device is suitable for various chemical reagents with different viscosities. Moreover, the viscosity selectors improve the accuracy of the monitoring device. In addition, due to the offsetting performed on the output of the position voltage generator, the monitoring device requires little time for adjustment and saves sampling time. Furthermore, the monitoring device ensures the accuracy of a chemical reagent supply system so that the quality of the product is improved.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A monitoring device for a fluid chemical reagent supply system, the chemical reagent supply system including a compressed air source, a pump having a cylinder, a piston, a piston rod mounted to the piston, and a bellows mounted to the piston rod, a regulator valve mounted to the compressed air source and the cylinder to govern the travel of the piston, and a signal source which is coupled to the regulator valve, and the system generating a demand signal to drive the regulator valve, the monitoring device comprising:

a position voltage generator for generating a position voltage according to a state of expansion of the bellows;

a processing circuit, responsive to the position voltage, a theoretical demand signal based on the viscosity of fluid in the bellows and a demand for the fluid reagent, to produce a difference signal indicative of a difference between an actual outflow of the reagent fluid and a theoretical demand outflow;

a comparator for producing an overriding signal indicative of whether the difference signal is within a predetermined signal range; and an alarm responsive to the overriding signal.

2. A monitoring device according to claim 1, including means for mounting the position voltage generator to the bellows.

3. A monitoring device according to claim 1, wherein the processing circuit includes:

a demand circuit responsive to a demand signal from equipment to receive the reagent fluid, for producing a theoretical demand signal representing the theoretical demand outflow of the reagent fluid to the equipment, based on the viscosity of the reagent fluid; and a subtracter, coupled to the position voltage generator and the demand circuit, for generating the difference signal.

4. A monitoring device according to claim 3, further comprising an overriding selector, responsive to the demand signal for generating a control signal, and an overriding device coupled to the comparator and the overriding mode selector to receive the control signal and the overriding signal, the overiding device locking the overriding signal according to the control signal and continually outputting an alarm signal.

5. A monitoring device according to claim 4, further comprising a voltage buffer amplifier, coupled to the position voltage generator for offsetting, adjusting and amplifying the position voltage, the offset, adjusted and amplified position signal being input to the subtracter.

6. A monitoring device for a fluid chemical reagent supply system, the chemical reagent supply system including a compressed air source, a pump having a cylinder, a piston, a piston rod mounted to the piston, and a bellows mounted to the piston rod, a regulator valve mounted to the compressed air source and the cylinder to govern the travel of the piston, and a signal source which is coupled to the regulator valve, and the system generating a first signal to drive the regulator valve, the monitoring device comprising:

a pre-treatment circuit coupled to the signal source, for pre-treating the first signal, to convert the first signal to a second signal;

a position voltage generator for mounting to the bellows, the position voltage generator generating a first voltage according to a state of expansion of the bellows;

a voltage generating device, responsive to the second signal for generating a second voltage according to a viscosity of a fluid reagent in the bellows;

a voltage buffer amplifier coupled to the position voltage generator for offsetting, adjusting and amplifying the first voltage to produce a third voltage;

a subtracter, coupled to the voltage generating device and the voltage buffer amplifier, for generating a fourth voltage according to a difference between the second voltage and the third voltage;

a comparator coupled to the subtracter, the comparator having settings of a maximum voltage and a minimum voltage, the comparator being responsive to the fourth voltage for generating an overriding signal based on a comparison of the fourth voltage with the minimum voltage and the maximum voltage, the overriding signal having a lock period;

an overriding mode selector coupled to the pre-treatment circuit, the overriding mode selector being responsive to the second signal for generating a control signal;

an overriding device coupled to the comparator and the overriding mode selector to receive the control signal and the overriding signal, the overiding device locking the overriding signal according to the control signal and continually outputting an alarm signal; and an alarm device coupled to the overriding device to receive the alarm signal, for outputting an alarm according to the alarm signal.

7. A monitoring device according to claim 6, wherein the pre-treatment circuit filters, amplifies and further processes the first signal to produce the second signal in a discrete form.

8. A monitoring device according to claim 6, wherein the voltage generating device further includes a voltage generator and a viscosity selector which is coupled to the voltage generator and specify the viscosity of the fluid in the bellows.

9. A monitoring device according to claim 6, wherein the alarm device further includes an alarm output circuit coupled to the overriding device, and an alarm coupled to the alarm output circuit.

10. A monitoring device according to claim 9, wherein the alarm includes an alarm light.

* * * * *